US005082431A

United States Patent [19]

Bein

[11] Patent Number: 5,082,431

[45] Date of Patent: Jan. 21, 1992

[54] MECHANICAL SCAVENGING SYSTEM FOR SINGLE SCREW COMPRESSORS

[75] Inventor: Thomas W. Bein, Annapolis, Md.

[73] Assignee: The United States of America as represented by the Secretary of the Navy, Bethesda, Md.

[21] Appl. No.: 885,478

[22] Filed: Jul. 3, 1986

[51] Int. Cl.[5] ..... F04C 18/20; F04C 27/02

[52] U.S. Cl. ..... 418/97; 418/195; 418/DIG. 1

[58] Field of Search ..... 418/97, 99, 195, DIG. 1, 418/196, 100

[56] References Cited

U.S. PATENT DOCUMENTS

| | | | |
|---|---|---|---|
| Re. 30,400 | 9/1980 | Zimmern | 418/188 |
| 3,133,695 | 5/1964 | Zimmern | 418/87 |
| 3,180,565 | 4/1965 | Zimmern | 418/99 |
| 3,632,239 | 1/1972 | Zimmern | 418/150 |
| 3,804,564 | 4/1974 | Zimmern | 418/195 |
| 3,945,778 | 3/1976 | Zimmern | 418/195 |

*Primary Examiner*—John J. Vrablik

*Attorney, Agent, or Firm*—Luther A. Marsh; John H. Stowe

[57] ABSTRACT

A scavenging system for single screw compressors to remove residual liquid seal from an open combustion chamber prior to controlled liquid seal injection. The removal of residual liquid seal is accomplished by providing at least one gaterotor as a scavenging means. Essentially the gaterotor will act as a scraper having a 1:1 compression ratio.

5 Claims, 1 Drawing Sheet

MECHANICAL SCAVENGING SYSTEM FOR SINGLE SCREW COMPRESSORS

BACKGROUND OF THE INVENTION

The present invention relates to single screw compressors and more particularly to a mechanical scavenging system for same.

In order to form single screw compressors, or positive displacement type machines for varying the pressure of a fluid such as air or gas, it is known to make use of combinations comprising a mainrotor, having a toroidal surface and projecting threads having a generally helicoidal shape e.g. Zimmern U.S. Pat. No. Re. 30,400. The crests of the threads are intended to cooperate with a casing, thereby forming compression chambers, and the mainrotor is adapted to cooperate with one or a number of gaterotors, the teeth of which are in meshing relation with the threads formed on the mainrotor.

The space formed between two adjacent threads of a mainrotor of this type can accordingly form a compression chamber which is sealed off at one end by a tooth of one of the gaterotors and sealed off at the other end by providing the casing with a closed end.

When a fluid such as air or gas, which can be at atmospheric pressure, is sucked into a compression chamber of this type, the rotation of the mainrotor permits a progressive reduction in the volume of the compression chamber, compressing the fluid until the compression chamber is put into communication with an outlet which can be formed in the casing.

Because there is relative motion between the parts in the single screw compressor, the clearance between the parts can only be reduced to a minimum finite value. Even when clearances have been reduced to operational minimums, there are still a large number of paths where the fluid being compressed can leak out.

Current practice in the design and manufacture of single screw compressors, to stem compressed fluid leaks, is to provide liquid seals e.g. Zimmern U.S. Pat. No. 3,133,695. By reason of the great speed with which heat is exchanged between the liquid seals and the metallic surfaces in contact with the fluid being compressed, the liquid seals also serve to cool the metallic surfaces being heated by that compressing fluid.

These liquid seals provide an almost perfect sealing since near the leakage zones the presence of a stream of liquid suffices to prevent the escape of gas, because the liquid has a much higher viscosity and inertia.

Typically a liquid seal such as water is injected in the intake area of the mainrotor. This liquid seal, driven along the threads of the mainrotor passes through the clearances between the mainrotor and the gaterotors, and is projected by centrifugal force against the walls of the casing where it forms a seal between the crests of the threads and the interior walls of the casing.

In practice, at the end of several cycles of operation all the threads of the mainrotor are covered by a film of water which forms an effective seal between the various compression chambers, the liquid seal accumulating at the base of each thread until it can pass out through the fluid outlet for the compressed gases. It should be noted that the streams of liquid seal which flow along the threads of the mainrotor are subjected to the pressure of the compressed gas, which tends to force this liquid seal through the clearances between the casing and the mainrotor toward the regions in which the gas is at a lower pressure, that is to say, toward the upper compression chambers, the liquid seal which thus leaks through being recovered in the next compression chamber.

However the only place where liquid sealing is needed of course is where gas is under compression. Typically a single screw compressor with two gaterotors has a number of compression chambers which are not compressing gas at a particular moment. For a gas in a compression chamber to be under compression it must be sealed by the casing at its crests, at one end by a casing closed end and at the other end by a gaterotor tooth.

Liquid seal injection into the compression chambers in a controlled manner effects proper sealing. However as noted supra some liquid seal is leaked from the compression chambers under compression to the upper chambers which are still not closed by a gaterotor tooth. And as noted supra this is recycled back into the system. But this recycling is in an uncontrolled manner in the sense that the predetermined liquid seal injected in a controlled manner is supplemented each cycle. The ultimate result is that in effect an excessive amount of liquid seal is injected into the compression chamber, which displaces gas that is under compression, adversely affecting compressor design criteria.

SUMMARY OF THE INVENTION

Accordingly, the present invention provides a mechanical scavenging system for single screw compressors to rid compression chambers of residual liquid seal prior to controlled injection with liquid seal. This is accomplished by providing the single screw compressor with a plurality of gaterotors wherein at least one gaterotor is in operative communication with a casing outlet means for providing a 1:1 compression ratio.

OBJECTS OF THE INVENTION

It is therefore an object of this invention to provide a mechanical scavenging system to control single screw compressor liquid seal injection systems.

A further object of the present invention is to provide a mechanical scavenging system that is of simple and reliable design.

A yet further object of the present invention is to provide a mechanical scavenging system such that it may be easily installed and used in conjunction with existing single screw compressor liquid seal injection systems.

BRIEF DESCRIPTION OF THE DRAWINGS

Other objects and many of the attendant advantages of the present invention becomes better understood by reference to the following detailed description with the appended claims, when considered in conjunction with the accompanying drawing, wherein:

DESCRIPTION OF THE PREFERRED EMBODIMENT

Figure 1:
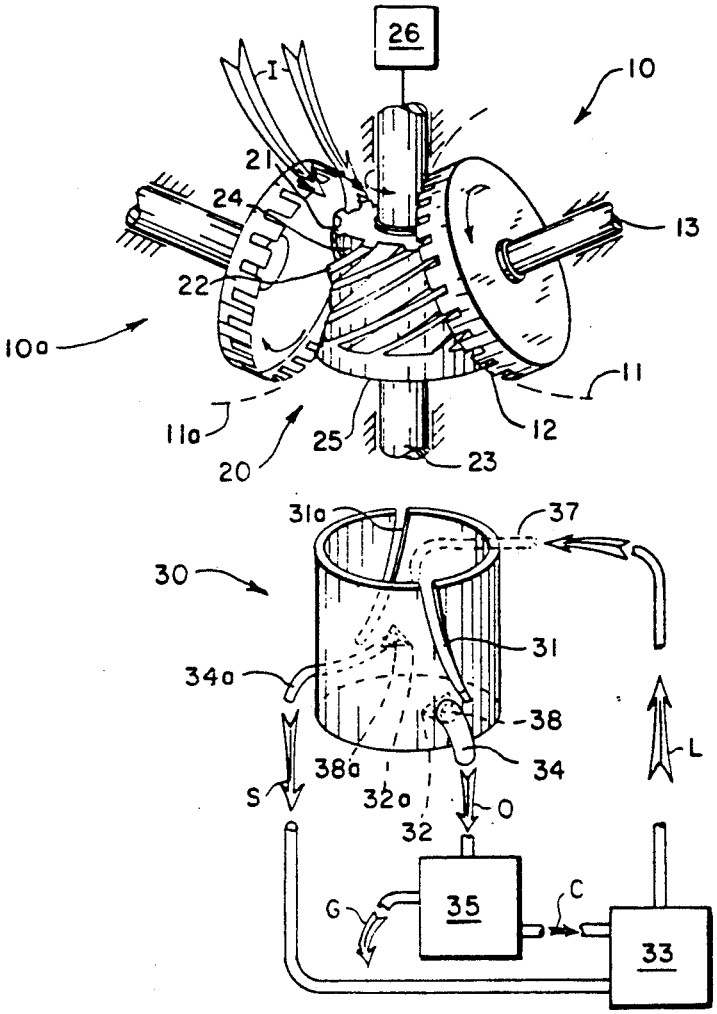
FIG. 1 is an exploded view in perspective of a single screw compressor showing the mechanical scavenging system of the present invention.

Referring now to the drawing wherein like reference characters designate like or corresponding parts throughout the several views, FIG. 1 shows a single screw compressor comprising a mainrotor 20, having a toroidal surface. By "toroidal surface" is meant a surface which has symmetry of revolution about an axis, which surface is generated by a curve in a plane containing or not containing the axis. Such surfaces may be "circularly toroidal" or "toric", when the curved generatirx is a circle or a circular arc lying in a plane containing said axis, or "non-circularly toroidal", when the curved generatirx is defined by a circle or a circular arc lying in a plane disposed at an angle to the meridianal plane of the surface. Mainrotor 20 has mainrotor thread 21 with a generally helicoid shape and is provided with mainrotor integral shaft 23. Mainrotor thread crests 22 are intended to cooperate with the interior of a casing 30, thereby forming mainrotor compression chambers 24. Mainrotor 20 is adapted to cooperate with a number of gaterotors 10 and 10*a*. Gaterotors 10 and 10*a* function in substantially an identical manner, so wherever possible, for clarity, their common operative characteristics will be described in terms of gaterotor 10. Gaterotor 10*a* and the compressor structure with which it is in operative communication with is denoted by a suffix "a". Gaterotor 10 comprises gaterotor teeth 12 which are in meshing relation with the mainrotor threads 21 formed on the mainrotor 20. Gaterotor teeth 12 pass through casing 30 via casing gaterotor slot 31 to accomplish meshing. Gaterotor path 11 denotes the path of gaterotor rotation. Mainrotor 20 is caused to rotate through operative connection with prime mover 26.

Gaterotor 10 is provided with gaterotor integral shaft 13. The space formed between two adjacent mainrotor threads 21 of the mainrotor 20 of this type can accordingly form a mainrotor compression chamber 24 which is sealed off at one end by a gaterotor tooth 12 of gaterotor 10 and sealed off at the other end by providing the mainrotor with a mainrotor closed end 25.

When a fluid intake I such as air or gas, which can be at atmospheric pressure, is sucked into a mainrotor compression chamber 24, the rotation of the mainrotor 20 permits a progressive reduction in the volume of the mainrotor compression chamber 24 until the mainrotor compression chamber 24 is put into communication with casing fluid outlet means 32 which can be formed in the casing 30. Fluid outlet means 32 comprises a fluid outlet bore means 38. For convenience, the outlet through casing outlet means 32 and fluid outlet bore means 38 may be designated by the term high pressure outlet.

Liquid seal L such as water is injected through liquid seal injection pipe means 37, which is in fluid communication only with mainrotor compression chambers 24 in the vicinity of fluid intake I adjacent gaterotor 10. There is no liquid seal injection adjacent gaterotor 10*a*. The liquid, seal injection is timed relative to the closure of the compression chamber 24 by gaterotor tooth 12 such that the volume of air taped in the thread is not displaced and such that the liquid seal enters the thread as close to the time of closure of the closed compression chamber 27 as possible. Liquid seal injection pipe means 37 is shown in phantom to conform with the fact that FIG. 1 is an exploded view. Liquid seal L, driven along the threads of the mainrotor 20 passes through the clearance between the mainrotor 20 and the gaterotors 10, and is projected by centrifugal force against the interior walls of the casing 30 where it forms a liquid seal between the mainrotor thread crests 22 of the mainrotor threads 21 and the interior walls of the casing 30.

Fluid output 0 i.e. cycled liquid seal along with compressed gas will ultimately pass through casing outlet means 32 which is in fluid communication with casing fluid outlet pipe means 34 via fluid outlet bore means 38. Fluid output 0 is further in fluid communication with a separator means 35 which separates fluid output 0 into compressed gas G and cycled liquid seal C. The separated cycled liquid seal C in the separator 35 is put in fluid communication with liquid injection means 33 which is in fluid communication with liquid seal injection pipe means 37.

Figure 2:
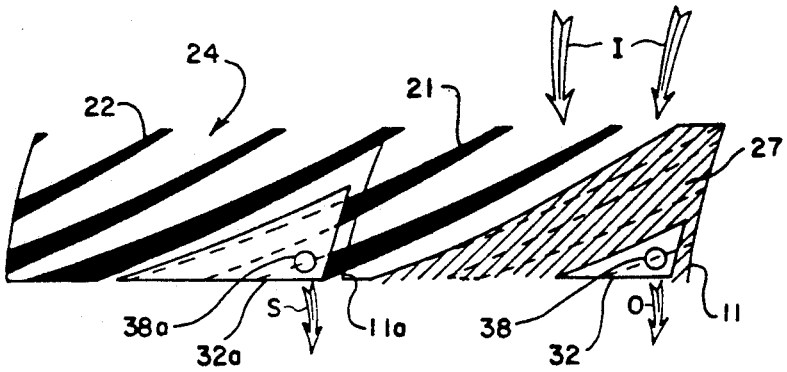
FIG. 2 is a developmental schematic view of a single screw compressor showing how the mechanical scavenging system of the present invention is employed.

The only place where liquid seal is needed is where gas is under compression. FIG. 2 shows mainrotor compression chambers sealed off by gaterotor teeth forming closed compression chambers 27 with the casing 30 shown in hatched lines. Liquid seal L is leaked due to the high pressure from the closed compression chamber 27 to the upper open mainrotor compression chambers 24 i.e. a compression chamber not yet closed off by a gaterotor tooth 12, by high pressure. Normally this liquid seal L leakage amounts to residual water which supplements the liquid seal injection process. The result being uncontrolled liquid seal injection as noted supra.

The present invention provides a mechanical scavenging system to rid compression chambers 24 of residual liquid seal S prior to controlled injection with liquid seal via liquid seal injection means 33 and obviously prior to that part of the compressor cycle where a closed compression chamber 27 occurs.

This is accomplished by providing the single screw compressor with at least one gaterotor 10*a* which is in operative communication with a casing outlet means 32*a* provided with a fluid outlet bore means 38*a* so designed as to provide approximately a 1:1 compression ratio. For convenience, the outlet through casing outlet means 32*a* and fluid outlet bore means 38*a* may be designated by the term auxiliary outlet. Essentially gaterotor 10*a* is acting as a scraper or scavenging system ridding compression chambers 24 of any residual liquid seal e.g. water.

Compression chamber 24 defines a gaterotor tooth displacement volume as a gaterotor tooth 12 closes off one end in the intake area I and displaces gas, by rotation of the mainrotor 20 permitting a progressive reduction in volume of the compression chamber, reaching fluid outlet means 32.

The ratio of the total volume of the gaterotor tooth displacement volume plus the clearance space volume to the volume of the clearance space is the compression ratio.

In the present invention the clearance space volume between fluid outlet means 32*a* and fluid outlet bore means 38*a* is such that it forms a compression ratio approaching 1:1 i.e. 1.1 to 1. Fluid outlet means 32*a* and fluid outlet bore means 38*a* being in a volumetric spaced relation.

Once gaterotor 10*a* scavenges any residual water the water is channeled through fluid outlet bore means 38*a* to fluid outlet pipe means 34*a* which is in fluid communication with liquid seal injection means 33 for controlled liquid seal injection.

Obviously, other embodiments and modifications of the present invention will readily come to those of ordinary skill in the art having the benefit of the teachings presented in the foregoing description and the drawing. It is therefore, to be understood that this invention is not to be limited thereto and that said modifications and embodiments are intended to be included within the scope of the appended claims.

What is claimed and desired to be secured by Letters Patent of the United States is:

1. A single screw compressor for varying the pressure of a fluid, comprising:

(a) a mainrotor formed with a plurality of threads;

(b) a casing, cooperating with the mainrotor thread crests, forming compression chambers;

(c) at least one compressively operative gaterotor with teeth which are in meshing relation with the mainrotor threads;

(d) a low pressure inlet communicative with said compression chambers;

(e) a high pressure outlet communicative with the fluid pressurized by said compressively operative gaterotor;

(f) a means for injection of a liquid seal only to the compression chambers communicative with said compressively operative gaterotor;

(g) at least one auxiliary gaterotor in meshing relation with said mainrotor threads for wiping residual liquid seal from said mainrotor threads; and, (h) an auxiliary outlet communicative with the liquid seal wiped from said mainrotor threads by said auxiliary gaterotor, said auxiliary outlet operative to scavenge said liquid seal from said mainrotor threads after communication of each said compression chamber with the high pressure outlet of said compressor and before communication of each said compression chamber with the low pressure inlet of said compression chamber.

2. A single screw compressor for varying the pressure of a fluid, as claimed in claim 1, wherein said auxiliary outlet is through a wall in said casing.

3. A single screw compressor for varying the pressure of a fluid, as claimed in claim 2, wherein the compression ratio associated with said auxiliary gaterotor and said auxiliary outlet is 1.1:1.

4. A single screw compressor for varying the pressure of a fluid, as claimed in claim 2, wherein the compression ratio associated with said auxiliary gaterotor and said auxiliary outlet is 1:1.

5. A single screw compressor as claimed in claim 2, wherein said auxiliary outlet is in fluid communication with a reservoir for scavenging said fluid for the purpose of recycling said fluid.

* * * * *